US005137387A

United States Patent [19]

Byrd et al.

[11] Patent Number: 5,137,387

[45] Date of Patent: Aug. 11, 1992

[54] COSMETIC APPLICATOR WITH ROTARY WIPING SYSTEM

[75] Inventors: Richard L. Byrd, Streamwood, Ill.; John M. B. Ford, Cordova, Tenn.

[73] Assignee: Maybe Holding Co., Inc., Wilmington, Del.

[21] Appl. No.: 713,272

[22] Filed: Jun. 11, 1991

[51] Int. Cl.[5] ..... A45D 40/00; A45D 40/26

[52] U.S. Cl. ..... 401/122; 401/126; 401/129

[58] Field of Search ..... 401/122, 126, 129; 132/218

[56] References Cited

U.S. PATENT DOCUMENTS

| | | | |
|---|---|---|---|
| 3,280,421 | 10/1966 | Davidson | 401/122 |
| 3,756,731 | 9/1973 | Aubry | 401/122 |
| 3,861,810 | 1/1975 | Vasas | 401/122 |
| 3,892,248 | 7/1975 | Kingsford | 132/218 |
| 4,437,477 | 3/1984 | Gueret | 401/122 X |
| 4,470,425 | 9/1984 | Gueret | 401/122 X |
| 4,671,689 | 6/1987 | Gueret | 401/122 |
| 4,810,122 | 3/1989 | Cole | 401/122 |
| 4,850,727 | 7/1989 | Gueret | 401/122 X |
| 4,922,934 | 5/1990 | Gatti . | |

FOREIGN PATENT DOCUMENTS

| | | | |
|---|---|---|---|
| 2339319 | 9/1977 | France | 401/122 |
| 2598299 | 11/1987 | France | 132/218 |

*Primary Examiner*—Steven A. Bratlie
*Attorney, Agent, or Firm*—Sherman and Shalloway

[57] ABSTRACT

An improved cosmetic package, particularly for eye make-up such as mascara, comprising a container, a cap having an applicator extendable into the container and a wiping body within the neck of the container. The package is particularly suited for applicators having an irregular cross-section and provides for threaded cooperation between the cap and container by a construction wherein the cap and applicator are relatively rotatable about their common longitudinal axis. An alternative construction provides for the applicator to be fixed within the cap and the wiping body to be relatively rotatable with the container about their common longitudinal axis. These constructions allow applicators with irregular cross-sections to be used in containers where the cap and container attach by means of cooperating threads.

12 Claims, 3 Drawing Sheets

COSMETIC APPLICATOR WITH ROTARY WIPING SYSTEM

BACKGROUND OF INVENTION

Cosmetic applicators, particularly those for eye make-up such as mascara and eye liner, generally comprise a container having a reservoir of cosmetic into which a wand is inserted for loading. The wand normally has a tip portion adapted to function as an applicator for different areas of the body. Quite often this wand is an integral part, or at least attached to, the cap of the container such that, when the cap is in place closing the container, the wand extends into the reservoir and is in contact with the cosmetic. In this condition cosmetic collects on the applicator in excess of that required for use and must be removed before application. Preferably, this is done by a wiping mechanism in the form of a collar within the neck of the container through which the wand passes. As the cap is removed and the wand withdrawn from the container, the collar removes the excess cosmetic that has collected on both the wand and the applicator tip.

The wand in these applicators is commonly round in cross-section and fixedly attached to the inside of the cap. The applicator tip is usually a brush or a pad, also having a generally round cross-section, longitudinally co-extensive with the longitudinal axis of the wand. Furthermore, to achieve a good sea and thereby prevent drying out or contamination of the cosmetic the securing of the cap to the container is usually by means of cooperating threads between the inside of the cap and the outside of the container neck.

U.S. Pat No. 4,922,934 to Gatti discloses a mascara applicator having a means within the cap to rotate the wand and its attached brush when a friction member is released.

Recently, different types of applicator tips for use with these devices have become popular, particularly flat combs and brushes. Such tips do not receive sufficient wiping from the wiping collars used with round tips. Accordingly, wiping collars having rectangular apertures have been devised. However, in order to allow the cap to rotate for application to and removal from the container, the wands of such applicators have remained round which complicates the manufacture of these devices. Particularly in the case of comb type applicators it would be preferred to form the comb on the end of a wand having a flat or irregular shape corresponding to that of the comb. However, such a shape would then prevent cap rotation thereby precluding the use of cooperating threads and the high degree of sealing achieved by that means.

Applicants have devised a method whereby applicators with flat or irregularly shaped wands may be used in conjunction with cosmetic containers having threaded caps wherein the wand extends outward from the inside of the cap along a longitudinal axis so as to depend into the container when the cap is in place.

SUMMARY OF THE INVENTION

The present invention relates to a mascara or similar cosmetic applicator comprising a container and a cooperating cap from the inside of which extends a wand in such a manner as to be inserted into the container when the cap is in place. The end of the wand remote from the cap is provided with an applicator tip having a substantially rectangular form such as a comb or flattened brush or other irregular shape. Similarly, the wand is of a flattened or irregular shaped cross-section.

Within the neck of the container is a wiping collar for the removal of excess cosmetic from the applicator wand and tip as they are removed. This wiping collar has a wiping element and an associated access aperture through which the wand passes. The aperture is formed in a shape to correspond to the shape of the wand and its tip. Thus, where the wand and tip are substantially flattened and rectangular, the aperture in the wiping collar and the wiping element are formed in a corresponding shape. Similarly, where the wand and tip are another substantially irregular shape the aperture and element will be formed to correspond to that shape.

In order to permit rotation of the cap for threading and unthreading from the container, the wand is assembled to the cap in a manner so as to be relatively rotatable thereto about their common longitudinal axis. Alternatively, the cap and wand are fixed and the wiping collar is adapted to be rotatable relative to and within the neck of the container about their common longitudinal axis. In this manner a wiping collar having an aperture and wiping element corresponding to the irregular shape or the wand and applicator may be used in conjunction with threaded attachment of the cap to the container. The continued use or cooperating threads with mascara applicators of this type is preferred because of its superior sealing which prevents drying out or contamination of the cosmetic.

It is therefore an object of this invention to provide a device for the application of cosmetics having means permitting an irregularly shaped shaft and applicator tip to be employed in combination with a threaded closure means and a wiping collar.

It is a further object of this invention to provide a cosmetic applicator in the nature of a mascara brush or comb of irregular shape attached to a wand of equally irregular shape and extending from within a threaded cap through a wiping collar having an opening of the same irregular shape and located in the neck of a container whereby relative rotation between the wand and the cap permit threaded attachment and removal of the cap to and from the container.

It is a still further object of this invention to provide a cosmetic applicator in the nature of a mascara brush or comb of irregular shape attached to a wand of equally irregular shape and extending from within a threaded cap through a wiping collar having an opening of the same irregular shape and located in the neck of a container whereby relative rotation between the wiping collar and the container permit threaded attachment and removal of the cap to and from the container.

Further objects and advantages will become evident from the accompanying drawings and description.

DETAILED DESCRIPTION OF THE INVENTION

Cosmetics are often packaged in a bottle with a screw cap to which an applicator is attached such that it extends into the bottle when the cap is screwed on. Mascara and eye liner are particularly packaged this way. In such packaging, the applicator is attached to or is part of an elongated wand which is mounted within the cap and extends longitudinally from the open, threaded end of the cap.

Figure 1:
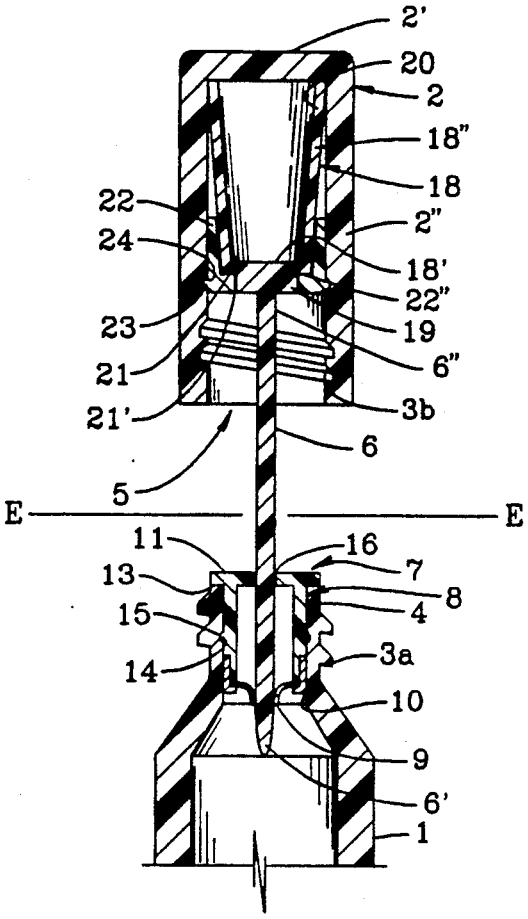
FIG. 1 is a longitudinal cross section of a mascara applicator cap and container incorporating a first embodiment of the present invention.

This arrangement is illustrated in FIG. 1 which also shows a first embodiment of the invention.

In this invention, the bottle 1 and the cap 2 are analogous to the common bottle and cap structure of a mascara product. Bottle 1 and cap 2 attach by means of cooperating threads 3*a* on the outer surface of the bottle neck 4 and threads 3*b* on the inner surface of the cap 2 and towards its open end 5.

Figure 1A:
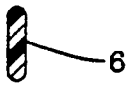
FIG. 1*a* is a horizontal cross-section of the wand of FIG. 1 taken along line E—E.

Preferred applicators according to this invention are of a shape other than round and are particularly combs or flattened brushes on the end of a wand having a comparable shape which extend outwardly from within the cap 2. Of particular interest to this invention are applicators having a flattened wand such that they are substantially rectangular in cross-section as shown in FIG. 1*a*. This figure shows the horizontal cross-section of wand 6 of FIG. 1 taken at line E—E.

Where, as here, the wand 6 is of a shape other than round means must be provided to permit cap 2 to rotate relative to bottle 1. Since the wand 6 must have a wiper configured to its shape for proper and effective wiping, cap rotation would not be possible in the conventional construction of such devices. Accordingly, either the wand must be permitted to rotate relative to the cap or the wiper must be rotatable relative to the bottle. The present invention provides embodiments for both of these conditions.

Figure 3:
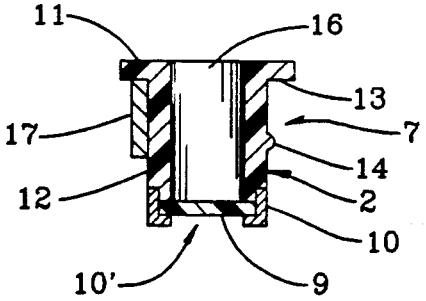
FIG. 3 is a longitudinal cross-section of figure two taken along line B—B.
Figure 4:
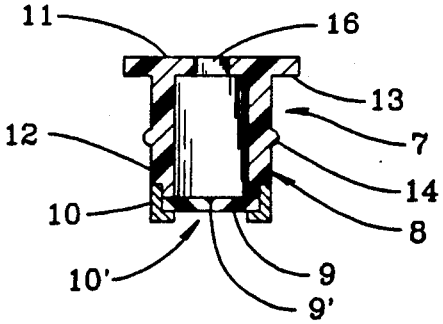
FIG. 4 is a longitudinal cross-section of figure two taken along line A—A.

Wands of this type require a wiper configured to their other than round shape. In the case of the rectangular wand 6, a wiper collar having a slit wiper is preferred. Such a collar 7 is shown in FIG. 1 installed within the neck 4 of bottle 1 and individually in FIGS. 2, 3 and 4.

Wiping collar 7 is a subassembly made up of a collar body 8 a wiping element 9 and a metal disk 10. The collar body 8 comprises a planar top 11 with a depending cylindrical skirt 12. Planar top 11 has a diameter corresponding to the outside diameter of the bottle neck 4 such that it forms a flange 13 about the skirt 12. When wiper 7 is inserted into the bottle neck 4, the lower surface of this flange sits on top of the upper edge of the neck 4. Circumferentially about the skirt 12 is an annular bead 14 which cooperates with a corresponding annular recess 15 within the bottle neck 4 to hold the wiper 7 in place in neck 4.

Through the planar top 11 of collar 7 is an aperture 16 of shape that corresponds to the shape of the wand 6. In the illustrated embodiment, aperture 16 is rectangular to correspond to the rectangular shape and size of wand 6. Furthermore, aperture 16 is preferably diametrically centered in the planar top 11.

Figure 2:
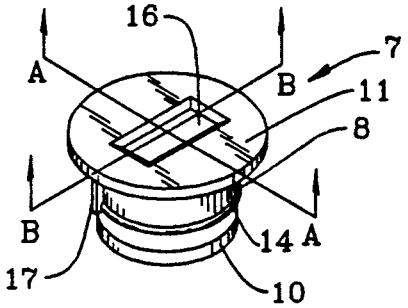
FIG. 2 is a perspective view of a wiper collar as used in a first embodiment of the present invention.

Collar body 8 is also provided with a vertical key lug 17 extending downward from flange 13. Key lug 17 cooperates with a corresponding key way (not shown) cut in the inside surface of bottle neck 4 to prevent rotation of collar 7 after its insertion into bottle neck 4. FIG. 2 illustrates key lug 17 as being in line with aperture 16 for convenience. Key lug 17 may be located at any position around the circumference of collar body 8.

At the lower edge of the skirt 12 is wiping element 9 which is held in place by metal disk 10 which is crimped in place around the lower edge of skirt 12. Disk 10 has a central aperture 10′ that corresponds to the inside diameter of skirt 12 and functions to hold wiping element 9 in place. Wiping element 9 is preferably a disk of flexible, elastomeric material such as natural or synthetic rubber and is provided with an elongated slit 9′ allowing the wand 6 to pass through it and be wiped upon withdrawal of the wand and applicator from the bottle.

It is important that aperture 16 be aligned with slit 9′ in wiping element 9 as one purpose of aperture 16 is to ensure that wand 6 is properly aligned when it is inserted and withdrawn so that adequate wiping of wand 6 and its attached applicator tip is achieved. Accordingly, the assembly of wiping element 9 to collar body 8 by disk 10 should be made so that the axis of slit 9′ corresponds to that of aperture 16 as shown by cross-section FIGS. 3 and 4.

In order for cap 2 to be threaded onto and off of bottle 1 by means of cooperating threads 3*a* and *b*, cap 2 must be able to rotate relative to bottle 1. The embodiment shown in FIG. 1 incorporating a fixed wiping collar 7 achieves this by making the wand 6 rotatable relative to the cap 2. In this manner while the wand 6 is engaged by the wiping collar 7 it is held against rotation and its connection with cap 2 is such as to permit the cap 2 to rotate relative to both the wand 6 and bottle 2. Although this rotation is required for removal and replacement of cap 2, the relative rotation of cap 2 and wand 6 should not be such as to allow wand 6 to freely rotate relative to cap 2 upon complete removal from Bottle 1. Too free a rotatability would render usage of the applicator extremely difficult as it would tend to rotate away from the desired point of application.

FIG. 1 illustrates one construction of the cap 2 and wand 6 whereby the desired relative rotation may be achieved.

As with conventional applicators, cap 2 comprises a top 2 with a cylindrical skirt 2″ depending from its periphery. Within the open lower end 5 are cut threads 3*b* which cooperate with threads 3*a* on neck 4. Wand 6 extends into cap 2 through open end 5. A length of wand 6 sufficient for insertion into bottle 1 to reach the cosmetic contained therein when cap 2 is applied to bottle 1 extends beyond the open end 5.

At the end of wand 6 opposite applicator tip 6′ is a cup 18 which may be a separate piece to which wand 6 is attached but which is preferably integrally molded as part of wand 6. Cup 18 comprises a base 18′ and an upstanding skirt 18″. Connection between cup 18 and wand 6 is made via block 19 between cup base 18′ and end 6" of wand 6. Preferably the entire assembly of wand 6, cup 18 and block 19 is a single molded piece.

Cup 18 is preferably frustoconical in shape tapering from a wider open top end 20 to a narrower base 18". The outside diameter of the open top end 20 is such that it fits snuggly within the inside diameter of cap 2. Block 19 is circular in plan and has a diameter smaller than that of base 18' such that a circumferential ledge 21 surrounds block 19.

The wand/cup combination is inserted into cap 2 until the open top end 20 butts against the inner surface of cap top 2'. The assembly is held in place by a collar 22 that fits around the lower end of cup 18 and has an aperture 22' through which wand 6 and block 19 may extend. An annular bead 23 on collar 22 cooperates with an annular groove 24 on the inside of cap skirt 2" to lock collar 22 in place. A shelf 22" circumferential about aperture 22' cooperates with ledge 21 of cup 18 to securely hold the wand/cup combination within cap 2.

The position of annular groove 24 within cap 2 is such that, when collar 22 is in place, it forces end 20 of cup 18 against the inner surface of cap top 2' with sufficient pressure such that friction prevents rotation of wand 6 when used to apply cosmetic. However, the friction between cup 18 and cap 2 is not so great that it cannot be overcome when wand 6 is held by wiping collar 7 and cap 2 is rotated to screw it on or off bottle 1.

Figure 5:
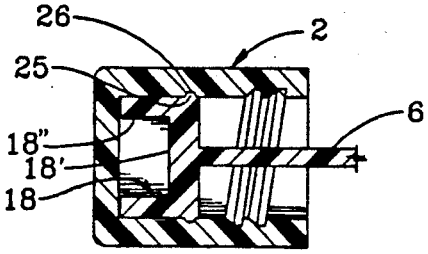
FIG. 5 is a longitudinal cross-section of an alternative construction of the cap portion of the embodiment in FIG. 1.

An alternative construction for this embodiment is shown in FIG. 5. Here, cup 18 is substantially cylindrical with an outside diameter at least equal to the inside diameter of cap 2. Wand 6 connects directly to cup base 18' without intervening block 19 of the first construction. Securement of the wand/cup combination within cap 2 is by means of annular bead 25 on cup 18 uniting with groove 26 within cap 2. Preferably, bead 25 is located circumferentially about base 18'. In this manner, the nee for collar 22 is eliminated and the required level of friction is achieved by a tight fit between cup 18 and cap 2.

Figure 6:
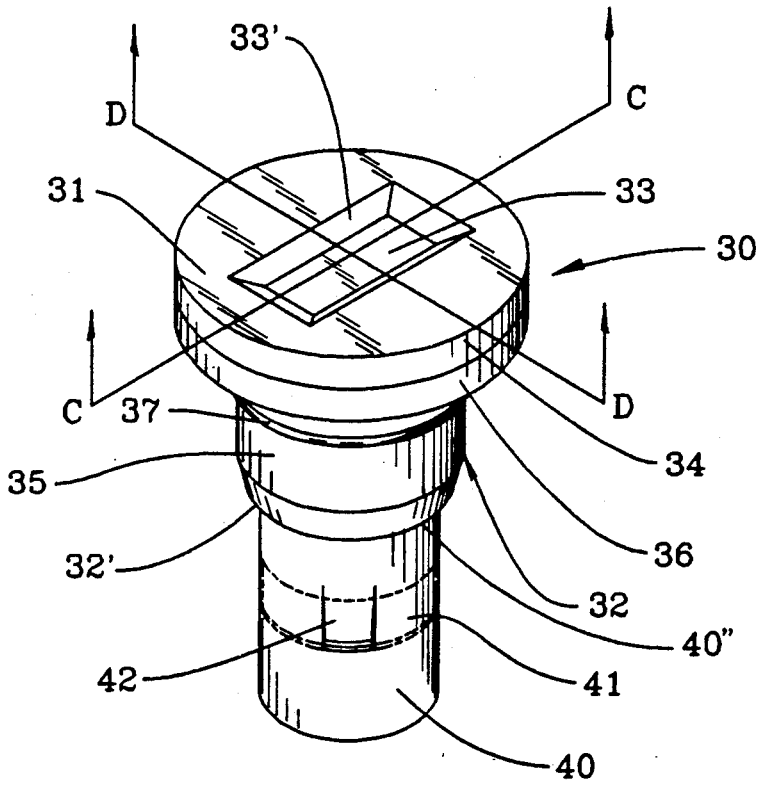
FIG. 6 is a perspective view of a wiper collar as used in a second embodiment of the present invention.
Figure 7:
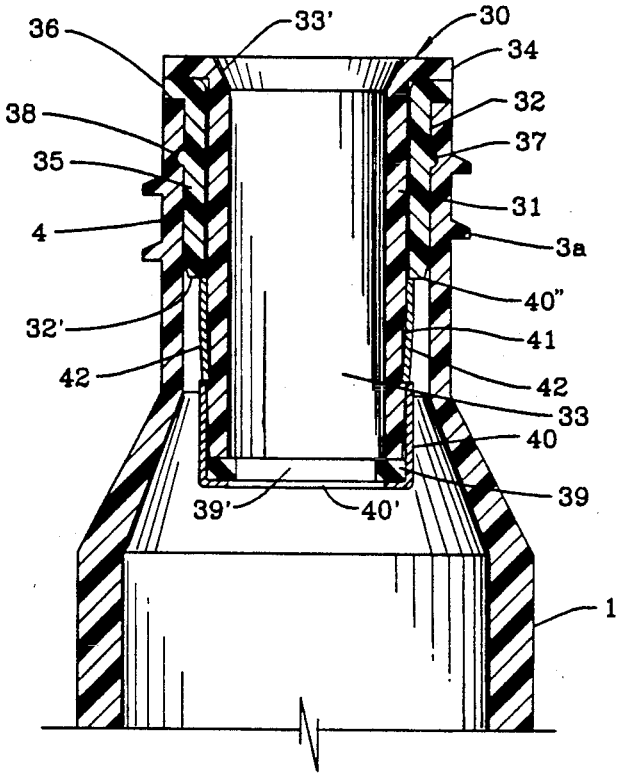
FIG. 7 is a longitudinal cross-section of the neck portion of a mascara container incorporating a second embodiment of the present invention along line C—C of FIG. 6.
Figure 8:
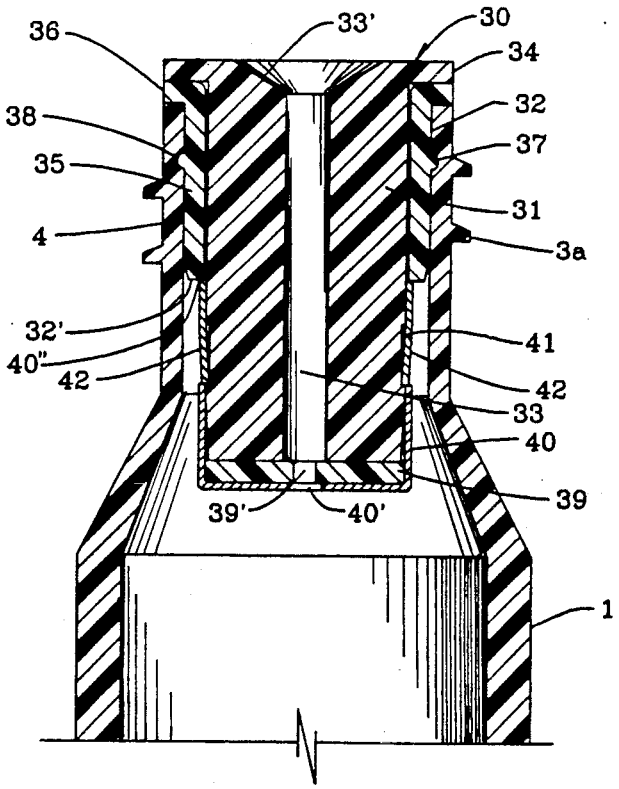
FIG. 8 is a longitudinal cross-section of the neck portion of a mascara container incorporating a second embodiment of the present invention along line D—D of FIG. 6.

In an alternative embodiment relative rotation between cap 2 from which extends applicator wand 6, and bottle 1 is achieved eve where wand 6 is fixedly attached to cap 2, by means of a wiping collar mounted within neck 4 of bottle 1 so as to be relatively rotatable thereto. FIGS. 6, 7 and 8 illustrate a wiping collar according to this embodiment.

In this embodiment cap 2 and wand 6 are substantially a described above with the exception that wand 6 is fixed within cap 2 so as to be non-rotatable. Such fixation may be by any means currently used in the manufacture of cap mounted applicators.

Wiper 30 comprises a wiper body 31 and a mounting collar 32 which are assembled in a telescopic relationship and inserted into neck 4 of bottle 1. Wiper body 31 is substantially cylindrical with a longitudinal through channel 33 which has a shape corresponding to the shape of wand 6. The entrance of through channel 33 in the upper surface of wiper body 31 is preferably formed with angled sides 33' to provide guidance for insertion of wand 6. Circumferentially about the upper end of wiper body 31 is a flange 34 which extends outward to a diameter equal to the outer diameter of bottle neck 4 forming a shelf by which wiper body 31 is supported in neck 4 with mounting collar 32 therebetween.

Wiper body 31 is inserted into mounting collar 32 which, in turn, is inserted into bottle neck 4. Mounting collar 32 comprises a cylindrical skirt 35 depending from an annular flange 36 and includes an annular bead 37 circumferentially about the outer surface of skirt 35. Bead 37 cooperates with an annular groove 38 in the inner surface of neck 4 to lock mounting collar 32 in place. The relative positioning of bead 37 and groove 38 is such that flange 36 sits on the top edge of neck 4 and serves as a bearing surface for wiper body flange 34.

The fit between mounting collar 32 and bottle neck 4 is sufficiently tight to prevent rotation of collar 32. Additional means to prevent such rotation may be employed such as a key lug and corresponding key way as in the previous embodiment. However, the fit between collar 32 and wiper body 31 is not tight and should be sufficiently loose so that wiper body 31 may freely rotate.

As shown in FIGS. 7 and 8, wiper body 31 has a length greater than that of mounting collar 32 and extends beyond the lower edge 32' of collar 32. At the bottom end of wiper body 31 is located a wiping element 39 which corresponds to wiping element 9 of the previous embodiment and has a slit 39' allowing passage of wand 6. Wiping element 39 is held in place against the end of upper body 31 by means of a retainer cup 40. Retainer cup 40 has a central aperture 40' corresponding in shape and at least as large as the area of through channel 33. Cup 40 is positioned so that aperture 40' is in line with through channel 33 and wiper slit 39' to allow passage of wand 6. Between the bottom edge of wiper body 31 and the level of the lower edge 32' of collar 32, an annular notch 41 is cut in the outer surface of wiper body 31. Retainer cup 40 is provided with indented spring legs 42 which engage notch 41 when cup 40 is placed thereon to hold both wiping element 39 and cup 40 in place. The upper edge 40" of cup 40, when in place, is in close proximity to lower edge 32' of mounting collar 32 and is of sufficient thickness to prevent wiper body 31 from being withdrawn from mounting collar 32. This relationship between cup 40 and mounting collar 32 is such as to not bind during rotation or wiper body 31 within collar 32.

In an alternative embodiment, which would be the counterpart to the alternative construction of the rotating wand embodiment, mounting collar 32 may be dispensed with as long as the materials from which bottle 1 and wiper body 31 are made have relatively low coefficients of friction so that wiper body 31 may freely rotate. In this alternative construction, annular bead 37 would be formed about wiper body 31 at a vertical level thereon to result in flange 34 resting on the top edge of neck 4. Since the bead 37 will serve to hold wiper body 31 in neck 4, retainer cup 40 may be modified to be a metal disk crimped around the lower end of wiper body 31 in the manner of disk 10 of the embodiment in FIGS. 1–4.

While the foregoing describes preferred embodiments of the present invention it is considered to include obvious variations that would occur to one skilled in the art.

What is claimed is:

1. In a container package comprising a container having an open end closable with a cap and capable of containing a quantity of cosmetic, said cap being threadable onto said open end by means of cooperating threads in said cap and on said container about said open end, an elongated applicator associated with and extending outward from within said cap along a common longitudinal axis and adapted to extend into said container and contact said cosmetic when said cap is in place on said container, and a wiping means within said open end of said container through which said applicator passes when inserted into and withdrawn from said container, wherein said applicator comprises an elongated wand having a first end bearing an applicator head and a second end having means connecting said wand within said cap, said wiping means has a longitudinal passage therethrough corresponding to the cross-section of said applicator and a wiping element adapted to remove excess cosmetic from said applicator, the improvement comprising means permitting relative rotation of said container and said cap about their common longitudinal axis when said applicator is inserted through said wiping means into said container and said applicator has a cross section which is other than round, said means permitting relative rotation comprising means for connecting said second end of said wand within said cap, said means comprising a body affixed to said second end of said wand and inserted into said cap and a collar fixable within said cap after said body confining said body within said cap in a snug yet movable manner, said collar having a central opening for passage of said wand, the diameter of said opening being sufficient to permit 360° rotation of said wand, thereby said collar bears against said body to maintain a friction between said body and said cap.

2. The container of claim 1 wherein said wand has a flattened rectangular cross-section and said applicator head has a width and thickness equal to said wand.

3. The container of claim 2 wherein said wiping means comprises a body adapted for insertion within the open end of said container and having a longitudinal passage corresponding in cross-section to said applicator and said wiping element comprises a resiliently flexible member attached to the inner end of said body

4. The container of claim 2 wherein said applicator head comprises a comb.

5. The container of claim 2 wherein said applicator head comprises brush means for holding and applying cosmetic.

6. In a container package comprising a container having an open end closable with a cap and capable of containing a quantity of cosmetic, said cap being threadable onto said open end by means of cooperating threads in said cap and on said container about said open end, an elongated applicator associated with and extending outward from within said cap along a common longitudinal axis to extend into said container and contact said cosmetic when said cap is in place on said container, and a wiping means within said open end of said container through which said applicator passes when inserted into and withdrawn from said container, said wiping means having a longitudinal passage therethrough, the improvement comprising said applicator having an irregular cross-section and said longitudinal passage having a corresponding cross-section and means permitting relative rotation of said container and said cap about their common longitudinal axis when said applicator is inserted through said wiping means into said container, said means permitting relative rotation comprising said wiping means which comprises a mounting collar fixedly located within said open end of said container, a wiping body inserted into said mounting collar and rotatable therein and having means retaining said body within said collar whereby said body is rotatable relative to said collar and said container about a common longitudinal axis, said body and said collar having respective lengths such that said body extends into said container beyond the lower edge of said collar, and a wiping element held against the lower end of said body by said retaining means.

7. The container of claim 6 wherein said retaining means comprises a cup disposed about the bottom end of said wiping body and secured thereto and holding said wiping element in place against said wiping body, said cup having a central aperture in line with said passage of said body for passage of said applicator, said cup extending upwards about said body a distance corresponding to the amount of said body extending below said collar the upper edge of said cup cooperating with the lower edge of said collar to retain said body within said collar.

8. The container of claim 6 wherein said applicator comprises an elongated wand having a first end fixed within said cap and a second end having an applicator head thereon, said wand extending from within said cap along a common longitudinal axis therewith, and wherein said longitudinal passage through said wiping means has an irregular cross-section corresponding to the cross-section of said applicator.

9. The container of claim 8 wherein said applicator and said longitudinal passage have a flattened rectangular cross-section.

10. The container of claim 6 wherein said collar comprises a circumferential flange and a depending skirt, said skirt having an outer diameter corresponding to the inner diameter of said open end of said container and wherein said wiper body comprises a cylindrical portion having a diameter slightly less than the inner diameter of said collar skirt and an outwardly extending circumferential flange about one end whereby said wiper body flange rests upon said collar flange when said body is inserted in said collar, said collar flange forming a bearing surface for said wiper body flange.

11. The container of claim 10 wherein said retaining means comprises a cup member having a circular base and an upstanding peripheral skirt adapted to fit over the lower end of said wiper body extending beyond said collar and having detent means cooperating with said wiper body to hold said retaining means in place, wherein the upper edge of said skirt cooperates with the lower edge of said collar to retain said wiper body within said collar and wherein the circular base of said retaining means has an aperture therein corresponding to the passage through said wiping body whereby said applicator may pass therethrough.

12. The container of claim 11 wherein said wiping element comprises a disk of flexible, elastomeric material and is held against the inner end of said wiper body by said retaining means, said wiping element having a slit therethrough corresponding to said longitudinal passage through said wiper body whereby said applicator may pass through said wiping element and be wiped thereby.

* * * * *